United States Patent [19]

Asao et al.

[11] Patent Number: 4,522,906

[45] Date of Patent: Jun. 11, 1985

[54] ELECTROPHOTOGRAPHIC PLATE-MAKING MATERIAL

[75] Inventors: Yasuzi Asao, Shizuoka; Ichiro Yamamoto, Chiba, both of Japan

[73] Assignee: Fuji Photo Film Co., Ltd., Kanagawa, Japan

[21] Appl. No.: 599,050

[22] Filed: Apr. 11, 1984

[30] Foreign Application Priority Data

Apr. 11, 1983 [JP] Japan ..... 58-63407

[51] Int. Cl.[3] ..... G03G 13/28; G03G 5/08; G03G 5/00

[52] U.S. Cl. ..... 430/60; 430/49; 430/59; 430/63; 430/129; 430/131

[58] Field of Search ..... 430/60, 63, 59, 129, 430/131, 49

[56] References Cited

U.S. PATENT DOCUMENTS 4,427,754 1/1984 Uchida et al. ..... 430/60

FOREIGN PATENT DOCUMENTS 7318325 6/1973 Japan .
0138904 11/1975 Japan .
0014804 2/1979 Japan .
0105580 8/1980 Japan .
191097 11/1982 Japan .
8070240 4/1983 Japan .

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

An electrophotographic plate-making material comprising a paper support and a photoconductive layer is described. This paper support is prepared by providing a polyolefin resin layer on both surfaces of a paper substrate by molten extrusion lamination, and is characterized in that the volume electric resistance is not more than $10^{10}\ \Omega$ and the polyolefin resin layer contains electrically conductive carbon black having a loss on drying, as determined under the conditions of 110° C. and 2 hours, of not more than 1.0%. Using this plate-making material, there can be produced a lithographic printing plate having good dimensional stability and long press life.

22 Claims, No Drawings

ELECTROPHOTOGRAPHIC PLATE-MAKING MATERIAL

FIELD OF THE INVENTION

The present invention relates to an electrophotographic plate-making material, i.e., a material from which a lithographic printing plate can be produced by an electrophotographic process.

BACKGROUND OF THE INVENTION

It is well known that a lithographic printing plate can be produced by an electrophotographic process. Such a lithographic printing plate is generally produced by uniformly charging a photoconductive layer of an electrophotographic plate-making material, exposing the thus charged photoconductive layer through an original to light, wet or dry developing to form a toner image corresponding to the original, fixing the toner image, and treating the material with a desensitizing solution (an etching solution) to make non-image areas, i.e., areas not carrying the toner image, hydrophilic.

Electrophotographic plate-making materials using a paper support have heretofore been known. Lithographic printing plates produced from such materials, however, are inferior in press life. That is, they can produce only about 3,000 copies. This is primarily caused by permeation of water through the paper support. That is, the etching solution, which is an aqueous solution, permeates through the paper when it is applied to make the non-image areas hydrophilic, and dampening water applied during the printing process permeates through the paper. The paper support stretches on absorbing water. In extreme cases, the paper support separates from the photoconductive layer.

With regard to the image quality, for example, in terms of dot reproductivity, up to about 100 lines per inch can be reproduced stably. This is considered ascribable to the change in water content of the paper support. That is, the water content of the paper support varies depending on the temperature and humidity conditions of the atmosphere in which the material is exposed to light, as a result of which, the electrical conductivity of the paper support changes, and this exerting adverse influences on the photographic performance.

Various proposals have been made to overcome the above described problems. One of the proposals is to provide an intermediate layer between the paper support and the photoconductive layer. For example, Japanese Patent Application (OPI) No. 138904/75 (the term "OPI" as used herein means a "published unexamined Japanese patent application") discloses an intermediate layer made of an epoxy resin; Japanese Patent Application (OPI) No. 105580/80 discloses an intermediate layer made of an ethylene derivatives such as an ethylene/acrylic acid copolymer, an ethylene/methacrylic acid copolymer, an ethylene/vinyl acetate copolymer, or an ethylene/vinyl acetate/vinyl chloride terpolymer; and Japanese Patent Application (OPI) No. 14804/79 discloses an intermediate layer prepared by coating an aqueous polyethylene emulsion which has been mixed with carbon black or graphite, and drying.

However, even if such electrophotographic plate-making materials with an intermediate layer provided thereto are used, it is not yet possible to produce a lithographic printing plate having long press life.

In addition, Japanese Patent Application (OPI) No. 191097/82 describes the use of paper coated with polyethylene containing carbon black as a support for an electrophotographic plate-making material. However, no details are disclosed therein about the type of carbon black. In practice, the carbon black is of low electric conductivity, and even if electrically conductive carbon black is used, it is necessary to add it an amount of at least 10% by weight in order to obtain the desired electric conductivity (in this case, the volume electric resistance is not more than $10^9$ Ω). At such high carbon black contents, in almost all cases, air bubbles are formed at the time of molten extrusion lamination and thus no satisfactory laminated material can be produced. In view of such electrical characteristics and appearance, the polyethylene-coated paper as described above is not suitable for practical use as a support for an electrophotographic plate-making material.

SUMMARY OF THE INVENTION

An object of the invention is to provide a support for an electrophotographic plate-making material which permits the production of a lithographic printing plate having good dimensional stability and long press life.

Another object of the invention is to provide an electrophotographic plate-making material, the photographic performance of which is negligibly affected by temperature and humidity.

A further object of the invention is to provide an electrophotographic plate-making material having superior electrical characteristics and appearance.

It has been found that the above objects are attained by using a specific carbon black.

The present invention relates to an electrophotographic plate-making material comprising a paper support and a photoconductive layer, said support being prepared by providing a polyolefin resin layer on both surfaces of a paper substrate by molten extrusion lamination, wherein the volume electric resistance of the support is not more than $10^{10}$ Ω, and the polyolefin resin layer contains electrically conductive carbon black having a loss on drying, as determined under the conditions of 110° C. and 2 hours, of not more than 1.0%.

DETAILED DESCRIPTION OF THE INVENTION

Suitable examples of the above described polyolefin resins are polyethylene and polypropylene. Particularly preferred are polyethylene having a density of 0.92 to 0.96 and a melt index of 1.0 to 30 g/10 min., and polypropylene having a density of 0.85 to 0.92 and a melt index of 1.0 to 30 g/10 min. The most preferred is polyethylene having the above specified density and melt index.

The polyolefin resin layer contains electrically conductive carbon black having a loss on drying at 110° C. for 2 hours of not more than 1.0% so that the volume electric resistance of the final support is not more than $10^{10}$ Ω, preferably not more than $10^8$ Ω, and most preferably not more than $10^6$ Ω.

The feature of the electrically conductive carbon black resides in that the chain-like structure resulting from interaction between the particles is greatly developed compared with other types of carbon black. It is said that electrical conductivity is exhibited by the chain-like structure. The degree of formation of the chain-like structure can be readily determined by the use of an electron microscope. Several methods have been developed to numerically represent the degree of formation of the chain-like structure. One of the methods utilizes a measure called a "shape factor" which is obtained by dividing the average chain length by the average particle diameter. It is generally said that electric conductivity is considerably high if the shape factor exceeds about 8.

Electrically conductive carbon includes acetylene black obtained by pyrolysis of acetylene, furnace black or channel black obtained by partial combustion of natural gas, heavy oils, etc., and the like. Of these carbon blacks, acetylene black is most preferred. The shape factor of acetylene black is about 12.

The use of electrically conductive carbon black having a loss on drying, as determined under the conditions of 110° C. and 2 hours, of not more than 1.0%, permits the production of a laminated member which is free from the formation of air bubbles involved in molten extrusion lamination and thus is superior in appearance, and furthermore, produces an advantage that irregularities in the electric conductivity of the support are reduced. This is considered due to improved dispersion of the carbon black.

The amount of the electrically conductive carbon black required for regulating the volume electric resistance of the support within the above specified range varies with the type of each of the paper substrate, polyolefin resin, and electrically conductive carbon black, and cannot be determined unconditionally. In general, the amount of the electrically conductive carbon black being added is about 10 to 30% by weight based on the polyolefin resin. If it is less than 10% by weight, the electrical conductivity is low, whereas it is in excess of 30% by weight, the viscosity increases excessively and molten extrusion lamination becomes impossible.

If necessary, to improve dispersibility of carbon black, dispersants may be added, or to prevent heat deterioration of polyethylene, antioxidants may be added. Suitable examples of dispersants include metallic soaps, alkyl sulfate salts, polyoxyethylene alkyl ether sulfate salts, polyoxyethylene alkylaryl ether sulfate salts, alkylaryl sulfonate salts, higher fatty acid alkylolamidosulfonic acid salts, polyoxyethylene alkyl ether, polyoxyethylene alkylaryl ether, sorbitan fatty acid esters, polyoxyethylene sorbitan fatty acid esters, polyoxyethylene fatty acid amide, and polyoxyethylene polypropylene glycol ether. Of the above described compounds, metallic soaps such as aluminum stearate and zinc stearate are most suitable. The amount of the dispersant added is preferably about 1 to 10% by weight based on the electrically conductive carbon black.

Suitable examples of antioxidants include phenol-based antioxidants, such as 2,6-di-tert-butyl-p-cresol, 2,6-di-tert-butylphenol, 2,4-di-methyl-6-tert-butylphenol, butylhydroxyanisol, 2,2'-methylenebis(4-methyl-6-tert-butyl-phenol), 4,4'-butylidenebis(3-methyl-6-tert-butylphenol), 4,4'-thiobis(3-methyl-6-tert-butylphenol), and tetraquis[methylene-3(3,5-di-tert-butyl-4-hydroxyphenyl)propionate]methane; amine-based antioxidants, such as phenyl-$\beta$-naphthylamine, N,N'-di-sec-butyl-p-phenylenediamine, phenothiazine, and N,N'-diphenyl-p-phenylenediamine; sulfur-based antioxidants, such as dilauryl thiodipropionate, distearyl thiodipropionate, laurylstearyl thiodipropionate, distearyl-$\beta,\beta'$-thiodibutyrate, and 2-mercaptobenzoimidazole; and phosphorus-based antioxidants, such as triphenyl phosphite, trioctadecyl phosphite, tridecyl phosphite, and trilauryl trithiophosphite. Of the above described compounds, phenolbased antioxidants are suitable. The most suitable is 4,4'-thiobis(3-methyl-6-tert-butylphenol). The amount of the antioxidant added is preferably about 0.1 to 1.0% by weight based on the electrically conductive carbon black.

The use of paper laminated on both surfaces as a support, said paper being prepared using a composition comprising a polyethylene resin, electrically conductive carbon black having a loss on drying, as determined under the conditions of 110° C. and 2 hours, of not more than 1.0%, metallic soap, and 4,4'-thiobis(3-methyl-6-tert-butylphenol), produces, of course, the above described effects and, furthermore, astonishingly prevents contamination at non-image areas of printed matters due to pressure or friction (which is usually called "pressure contamination").

The polyolefin resin composition is usually kneaded in, for example, a kneader or bumbury mixer and shaped into master pellets. The carbon black content in such carbon black-containing master pellets may be changed and is usually between 10 and 50% by weight. These master pellets are used as such or after being diluted. It is preferred for the master pellets to be dried as much as possible. If the loss of the master pellet when it is placed under a reduced pressure of 760 mmHg at 80° C. for 4 hours is not more than 15% by weight (not more than 0.1% by weight as calculated as the carbon black), air bubbles are not formed at the time of molten extrusion lamination and thus a good laminated member can be produced.

The above described polyolefin resin composition is coated on both surfaces of a paper substrate by a molten extrusion lamination method. It is this molten extrusion lamination method that permits the production of an electrophotographic plate-making material from which can be prepared a lithographic printing plate having superior image quality and long press life. This is one of the features of the invention. The term "molten extrusion lamination method" as used herein means a method in which a polyolefin resin is melted at a temperature ranging between 280° and 320° C., shaped into a film, immediately press-bonded on to a paper substrate, and then cooled to form a laminate. Various types of equipment are known for this molten extrusion lamination method.

The thickness of the polyolefin resin layer to be laminated by the molten extrusion lamination method is appropriately about 5 to 50$\mu$. If the thickness is less than 5$\mu$, the ability of the polyolefin resin layer to prevent the permeation of water to the paper substrate is poor. On the other hand, if it is in excess of 50$\mu$, no further increase in performance can be expected and thus it increases only production costs. Hence the preferred thickness if about 10 to 40$\mu$.

In order to increase the adhesion between the paper substrate and the polyolefin resin layer, it is preferred for the paper substrate to be coated with polyethylene-derivatives such as an ethylene/vinyl acetate copolymer, an ethylene/acrylate copolymer, an ethylene/methacrylate copolymer, an ethylene/acrylic acid copolymer, an ethylene/methacrylic acid copolymer, an ethylene/acrylonitrile/acrylic acid copolymer, and an ethylene/acrylonitrile/methacrylic acid copolymer, or for the surface of the paper substrate to be subjected to a corona discharge treatment. Additionally, surface treatments as described in Japanese Patent Application (OPI) Nos. 24126/74, 36176/77, 121683/77, 2612/78, 111331/79, and Japanese Patent Publication No. 25337/76 can be applied.

As the paper substrate as used herein, any of electrically conductive paper substrates which have heretofore been used in electrophotographic light-sensitive materials can be used. For example, paper substrates prepared by impregnating paper with ion conductive substances or electron conductive substances, such as inorganic metal compounds, carbon, etc., as described in U.S. Pat. No. 3,597,272 and French Pat. No. 2,277,136, or by mixing such substances at the time of paper-making, and synthetic papers as described in Japanese Patent Publication Nos. 4239/77, 19031/78, and 19684/78 can be used. It is desirable for the basis weight to be from 50 to 200 g/m$^2$ and for the thickness to be from 50 to 200$\mu$.

The photoconductive layer to be coated on the above described support is comprises a photoconductive substance and a binder. Photoconductive substances which can be used include inorganic photoconductive substances such as zinc oxide, cadmium sulfide, and titanium oxide, and organic photoconductive substances such as phthalocyanine dye.

Binders which can be used include a silicone resin, and polystyrene, polyacrylate or polymethacrylate, polyvinyl acetate, polyvinyl chloride, polyvinyl butyral and their derivatives. The weight ratio of the photoconductive substance to the binder is suitable to be between 3:1 and 20:1. If necessary, a sensitizer, a coating aid which is used in coating, etc. can be added. The photoconductive substance is applied on the polyolefin-laminate layer on the substrate.

It is preferred for the polyolefin resin layer to be previously subjected to surface treatments such as a corona discharge treatment, a glow discharge treatment, a flame treatment, an ultraviolet treatment, an ozone treatment, and a plasma treatment, as described in, for example, U.S. Pat. No. 3,411,908, since it results in an increase in the adhesion force between the polyolefin resin layer and the photoconductive layer. The thickness of the photoconductive layer is appropriately about 5 to 30$\mu$.

Heretofore known techniques can be employed in the production of lithographic printing plates using the above described electrophotographic plate-making materials comprising a paper support and a photoconductive layer. A typical procedure is described below.

The photoconductive layer is uniformly charged by a corona charging method and then exposed imagewise to light to form a charged or latent image. This image is developed by a wet method or a dry method to form a toner image which is then fixed by, for example, heating. Non-image areas to which no toner attaches are made hydrophilic by treating with a desensitizing solution (an etching solution).

Etching solutions which can be used include a composition containing a ferrocyanide or ferricyanide compound as described in U.S. Pat. No. 4,116,698, and a composition containing a metal complex salt as described in U.S. Pat. No. 4,282,811. By conducting offset printing by the conventional method using the above prepared lithographic printing plate, more than 10,000 copies having superior image quality can be produced.

The volume electric resistance of the paper support is not more than $10^{10}$ $\Omega$. Since a solvent is not used in providing the polyolefin resin layer, the electric conductivity or uniformity of the paper substrate is not reduced. This presents advantages in that the electrophotographic characteristics are less reduced compared with the case that polyethylene derivatives are dissolved in solvents and coated as in Japanese Patent Application (OPI) No. 105580/80 and thus excellent image quality can be obtained. For example, when a wet developing method is employed, dot images of 100 lines per inch can be reproduced in conventional plate-making materials, whereas dot images of 133 lines per inch can be reproduced in the plate-making material of the invention.

Japanese Patent Application (OPI) No. 14804/79 describes the preparation of a precoat layer in which a low molecular weight polyethylene emulsion, a finely divided polyethylene aqueous dispersion or a self-emulsifiable polyethylene emulsion is mixed with carbon black to form an aqueous dispersion and the thus formed aqueous dispersion is then coated to form the precoat layer. This method, however, suffers from various disadvantages. For example, carbon black or polyethylene is difficult to provide in the form of a thin layer due to a permeation of coating liquid into a paper substrate, and a precipitation of carbon black is likely to occur during the preparation of the aqueous dispersion, and performance, for example, water resistance and adhesion between the paper substrate and the above described precoat layer are not sufficiently satisfactory.

The present invention is free from the above described problems since the polyolefin resin layer is provided by the molten extrusion lamination method.

In the present invention, since electrically conductive carbon black having a loss on drying, an determined under the conditions of 110° C. and 2 hours, of not more than 1.0% is used in the polyolefin resin, a paper support can be obtained which is freed of the formation of air bubbles at the time of molten extrusion lamination and thus is superior in appearance and, furthermore, in which irregularities in electric conductivity are reduced. By adding a specific dispersant (e.g., metallic soap) and an antioxidant (e.g., 4,4'-thiobis(3-methyl-6-tert-butylphenol)), non-image area contamination of printed matters due to pressure or friction can be controlled.

The volume electric resistance as used herein is determined as follows:

A test piece is sandwiched between two circular metallic electrodes (diameter: 2.5 cm), and a current, A, when a D.C. voltage, V, is applied is read. The volume electric resistance is calculated from the following equation:

$$R_v = V/A(\Omega)$$

The volume electric resistance of the support is a major factor exerting great influences on the performance of an electrophotographic print-making material, and is determined by the intrinsic volume electric resistance and thickness of the support. However, since the support of the invention is a composite one and thus its intrinsic volume electric resistance is determined by the intrinsic volume electric resistances of the paper substrate and electrically conductive substance-containing polyolefin resin layer and the ratio in thickness of the paper substrate to the polyolefin resin layer, the volume electric resistance of the paper support of the invention cannot be determined unconditionally. Hence, in the present invention, the volume electric resistance of the support is represented by the resistance value as obtained by the above described method of measurement.

The present invention is described in greater detail with reference to the following example. All percents (%) and parts are by weight unless otherwise indicated.

EXAMPLE

A high quality paper with a basis weight of 100 g/m$^2$ was coated with a 5% aqueous solution of calcium chloride in an amount of 20 g/m$^2$ and then dried to form an electrically conductive paper substrate.

Both surfaces of the above prepared paper substrate were coated with a coating solution having the formulation as described below in a dry coating amount of 0.5 g/m$^2$ and dried.

| Coating Solution | |
|---|---|
| Emulsion having an ionomer solid content of 50% (ethylene: 95 mol %; acrylic acid: 5 mol %; degree of neutralization: 85%; metal: $Na^+$ | 20 g |
| Water | 80 ml |

A mixture consisting of 84.14% of polyethylene (density: 0.92; melt index: 2.0 g/10 min.), 15% of electrically conductive acetylene black having a loss on drying, as determined under the conditions of 110° C. and 2 hours, of 0.8%, 0.8% of zinc stearate, and 0.05% of 4,4'-thiobis(3-methyl-6-tert-butylphenol) was molten kneaded and shaped into pellets. Using these pellets, a polyethylene layer was laminated on both surfaces of the above prepared paper substrate each in a thickness of 25$\mu$ by the molten extrusion lamination method to form a support with the polyethylene layer uniform in thickness. In this lamination at an extrusion temperature of 300° C., air bubbles were not formed and thus a high quality laminate could be obtained. The volume electric resistance of the support was $5\times10^8\ \Omega$.

The surface of the polyethylene layer on one side of the support was subjected to a corona discharge treatment at 5 KVA.sec./m$^2$, and a coating solution having the formulation as described below was coated on the above treated polyethylene layer in a dry coating amount of 20 g/m$^2$ and dried to form a photoconductive layer.

| Coating Solution | Amount (parts) |
|---|---|
| Photoconductive zinc oxide (Sazex 2000, produced by Sakai Kagaku Kogyo Co., Ltd.) | 100 |
| Silicone resin (KR-211, produced by Shinetsu Kagaku Kogyo Co., Ltd.) | 35 |
| Rose bengale | 0.1 |
| Fluorescein | 0.2 |
| Methanol | 10 |
| Toluene | 150 |

The thus prepared electrophotographic plate-making material was allowed to stand for 12 hours in the dark place maintained at 25° C. and 45% RH (relative humidity), from which a printing plate was produced by the use of Itek plate-making machine, Model 135 (produced by Itek Co.). This plate was treated with an etching solution (produced by Addressograph Multigraph Co.) and mounted on an offset printer, Hamada Star 700. Printing was performed with the results that more than 10,000 copies having superior image quality, i.e., reproducing dot images of 133 lines per inch, could be produced. In this case, background contamination of printed matters due to pressure or friction did not occur.

While the invention has been described in detail and with reference to specific embodiments thereof, it will be apparent to one skilled in the art that various changes and modifications can be made therein without departing from the spirit and scope thereof.

What is claimed is:

1. An electrophotographic plate-making material comprising a paper support and a photoconductive layer, said support being prepared by providing a polyolefin resin layer on both surfaces of a paper substrate by molten extrusion lamination, wherein the volume resistance of the support is not more than $10^{10}\ \Omega$, and the polyolefin resin layer contains electrically conductive carbon black having a loss on drying, as determined under the conditions of 110° C. and 2 hours, of not more than 1.0%.

2. The electrophotographic plate-making material as in claim 1 wherein said polyolefin resin is selected from the group consisting of polyethylene and polypropylene.

3. The electrophotographic plate-making material as claimed in claim 2 wherein said polyethylene has a density of 0.92 to 0.96 and a melt index of 1.0 to 30 g/10 min., and said polypropylene has a density of 0.85 to 0.92 and a melt index of 1.0 to 30 g/10 min.

4. The electrophotographic plate-making material as claimed in claim 1 wherein said volume electric resistance is not more than $10^8\ \Omega$.

5. The electrophotographic plate-making material as claimed in claim 4 wherein said volume electric resistance is not more than $10^6\ \Omega$.

6. The electrophotographic plate-making material as claimed in claim 1 wherein said electrically conductive carbon is selected from the group consisting of acetylene black obtained by pyrolysis of acetylene, furnace black or channel black obtained by partial combustion of natural gases and heavy oils.

7. The electrophotographic plate-making material as claimed in claim 6 wherein said electrically conductive carbon black is acetylene black obtained by pyrolysis of acetylene.

8. The electrophotographic plate-making material as claimed in claim 1 wherein the amount of said electrically conductive black employed is about 10 to 30% by weight based on the polyolefin resin.

9. The electrophotographic plate-making material as claimed in claim 1 wherein said polyolefin layer additionally contains a dispersant.

10. The electrophotographic plate-making material as claimed in claim 1 wherein said polyolefin layer additionally contains an antioxidant.

11. The electrophotographic plate-making material as claimed in claim 9 wherein said dispersant is added in an amount of about 1 to 10% by weight based on the electrically conductive carbon black.

12. The electrophotographic plate-making material as claimed in claim 10 wherein said antioxidant is added in an amount of about 0.1 to 1.0% by weight based on the electrically conductive carbon black.

13. The electrophotographic plate-making material claimed in claim 1 wherein said paper support is a double-laminated paper support.

14. The electrophotographic plate-making material as claimed in claim 1 wherein said polyolefin resin layer has a thickness of about 5 to 50$\mu$.

15. The electrophotographic plate-making material as claimed in claim 14 wherein said polyolefin resin layer has a thickness of about 10 to 40 microns.

16. The electrophotographic plate-making material as claimed in claim 1 wherein an polyethylene derivative layer is provided between said paper substrate and said polyolefin resin layer.

17. The electrophotographic plate-making material as claimed in claim 16 wherein said polyethylene derivative is selected from the group consisting of ethylene/-vinyl acetate copolymer, ethylene/acrylate copolymer, ethylene/methacrylate copolymer, ethylene/acrylic acid copolymer, ethylene/methacrylic acid copolymer, ethylene/acrylonitrile/acrylic acid copolymer, and ethylene/acrylonitrile/methacrylic acid copolymer.

18. The electrophotographic plate-making material as claimed in claim 1 wherein the surface of the paper substrate is subjected to a corona discharge treatment prior to providing the polyolefin resin thereon.

19. The electrophotographic plate-making material as claimed in claim 1 wherein said paper substrate has a base weight of about 50 to 200 g/m$^2$ and a thickness of from about 50 to 200$\mu$.

20. The electrophotographic plate-making material as claimed in claim 1 wherein said photoconductive substance is selected from the group consisting of zinc oxide, cadmium sulfide, titanium oxide, and phthalocyanine dye.

21. The electrophotographic plate-making material as claimed in claim 1 wherein said polyolefin resin layer is subjected to a surface treatment selected from the group consisting of corona discharge treatment, glow discharge treatment, flame treatment, ultraviolet treatment, ozone treatment, and plasma treatment, prior to providing said photoconductive layer thereon.

22. The electrophotographic plate-making material as claimed in claim 1 wherein said photoconductive layer has a thickness of about 5 to 30$\mu$.

* * * * *